US012595144B2

(12) United States Patent
Seki et al.

(10) Patent No.: US 12,595,144 B2
(45) Date of Patent: Apr. 7, 2026

(54) MEDIA FEEDING APPARATUS

(71) Applicant: PFU LIMITED, Kahoku (JP)

(72) Inventors: Kazuhito Seki, Kahoku (JP); Tomoyuki Niwata, Kahoku (JP)

(73) Assignee: PFU LIMITED, Kahoku (JP)

( * ) Notice: Subject to any disclaimer, the term of this patent is extended or adjusted under 35 U.S.C. 154(b) by 0 days.

(21) Appl. No.: 18/752,429

(22) Filed: Jun. 24, 2024

(65) Prior Publication Data

US 2025/0002279 A1 Jan. 2, 2025

(30) Foreign Application Priority Data

Jun. 29, 2023 (JP) ..... 2023-107355

(51) Int. Cl.
*B65H 3/52* (2006.01)

(52) U.S. Cl.
CPC ..... *B65H 3/5215* (2013.01); *B65H 2403/732* (2013.01); *B65H 2404/144* (2013.01); *B65H 2404/1521* (2013.01)

(58) Field of Classification Search
CPC ..... B65H 3/5215; B65H 2404/144; B65H 2404/1521; B65H 3/523
See application file for complete search history.

(56) References Cited

U.S. PATENT DOCUMENTS

| | | | | |
|---|---|---|---|---|
| 5,172,900 | A * | 12/1992 | Uno | B65H 3/5261 271/274 |
| 5,501,444 | A | 3/1996 | Yukimachi et al. | |
| 6,260,839 | B1 * | 7/2001 | Araki | B65H 3/0669 271/147 |
| 10,589,948 | B2 * | 3/2020 | Inui | B65H 3/0676 |
| 12,017,882 | B2 * | 6/2024 | Umi | B65H 3/5284 |
| 12,319,529 | B2 * | 6/2025 | Otsuka | B65H 7/20 |
| 2022/0169463 | A1 | 6/2022 | Umi | |

FOREIGN PATENT DOCUMENTS

| | | | |
|---|---|---|---|
| JP | H7-144772 | A | 6/1995 |
| JP | 2008-260612 | A | 10/2008 |
| JP | 2022-86609 | A | 6/2022 |

* cited by examiner

*Primary Examiner* — Patrick Cicchino
(74) *Attorney, Agent, or Firm* — Womble Bond Dickinson (US) LLP

(57) ABSTRACT

A media feeding apparatus includes a feed roller, a separation roller, a torque limiter, a unit, a pressing portion, and a reaction-force generator. The feed roller feeds a medium. The separation roller faces the feed roller and is located on a rotation shaft to which power is not transmitted. The torque limiter is located on the rotation shaft. The separation roller is driven by the feed roller when a torque greater than a predetermined torque is applied to the torque limiter. The unit supports the rotation shaft. The pressing portion applies a pressing force to the unit to swing the unit in a direction in which the separation roller is pressed against the feed roller. The reaction-force generator generates a reaction force to swing the unit in a direction in which the separation roller moves away from the feed roller as the separation roller rotates.

6 Claims, 8 Drawing Sheets

MEDIA FEEDING APPARATUS

CROSS-REFERENCE TO RELATED APPLICATION

This patent application is based on and claims priority pursuant to 35 U.S.C. § 119 (a) to Japanese Patent Application No. 2023-107355, filed on Jun. 29, 2023, in the Japan Patent Office, the entire disclosure of which is hereby incorporated by reference herein.

BACKGROUND

The present disclosure relates to a media feeding apparatus.

In general, a media feeding apparatus such as a scanner feeds multiple media while separating the media using a feed roller for feeding the media and a separation roller facing the feed roller.

A document separating-and-feeding apparatus has been proposed in which original documents placed on a document feed tray are separated and fed one by one by the action of a separation roller and a retard roller elastically contacting the separation roller. In the document separating-and-feeding apparatus, a retard roller unit is constituted by the retard roller, a retard roller shaft for concentrically holding the retard roller, and a driven transmission gear fixed concentrically to the retard roller shaft. A drive transmission means for transmitting the drive to the retard roller is located in a body of the document separating-and-feeding apparatus. The drive transmission means is provided with a rotary drive shaft, a drive transmission gear which meshes with the driven transmission gear to transmit the rotational drive force from the rotary drive shaft, and a pair of brackets that are supported to be swingable around the axis of the drive transmission gear and have bearings supporting both axial ends of the retard roller shaft.

A media conveying apparatus that includes a feed roller to feed media, a separation roller facing the feed roller to separate media, and a motor to generate a driving force for rotating the separation roller in a direction opposite to a media feeding direction has been proposed. The medium conveying apparatus includes a unit that includes a first gear rotating in accordance with a driving force generated by the motor, a second gear located on a rotation shaft of the separation roller, and a third gear located between the first gear and the second gear. The unit is supported to be swingable about a shaft of the first gear as a rotation shaft. A torque limiter limits the torque of rotating the separation roller in the direction opposite to the rotation direction of the feed roller, and the force generated by this limitation of the torque pushes the separation roller toward the feed roller. The first gear rotates in a direction in which the force of moving the separation roller away from the feed roller is generated by the rotation of the motor.

SUMMARY

A media feeding apparatus according to one aspect of the present disclosure includes a feed roller, a separation roller, a torque limiter, a unit, a pressing portion, and a reaction-force generator. The feed roller feeds a medium. The separation roller faces the feed roller and is located on a rotation shaft to which power is not transmitted. The torque limiter is located on the rotation shaft. The separation roller is driven by the feed roller when a torque greater than a predetermined torque is applied to the torque limiter. The unit supports the rotation shaft. The pressing portion applies a pressing force to the unit to swing the unit in a direction in which the separation roller is pressed against the feed roller. The reaction-force generator generates a reaction force to swing the unit in a direction in which the separation roller moves away from the feed roller as the separation roller rotates.

BRIEF DESCRIPTION OF THE DRAWINGS

A more complete appreciation of embodiments of the present disclosure and many of the attendant advantages and features thereof can be readily obtained and understood from the following detailed description with reference to the accompanying drawings, wherein.

Figure 1:
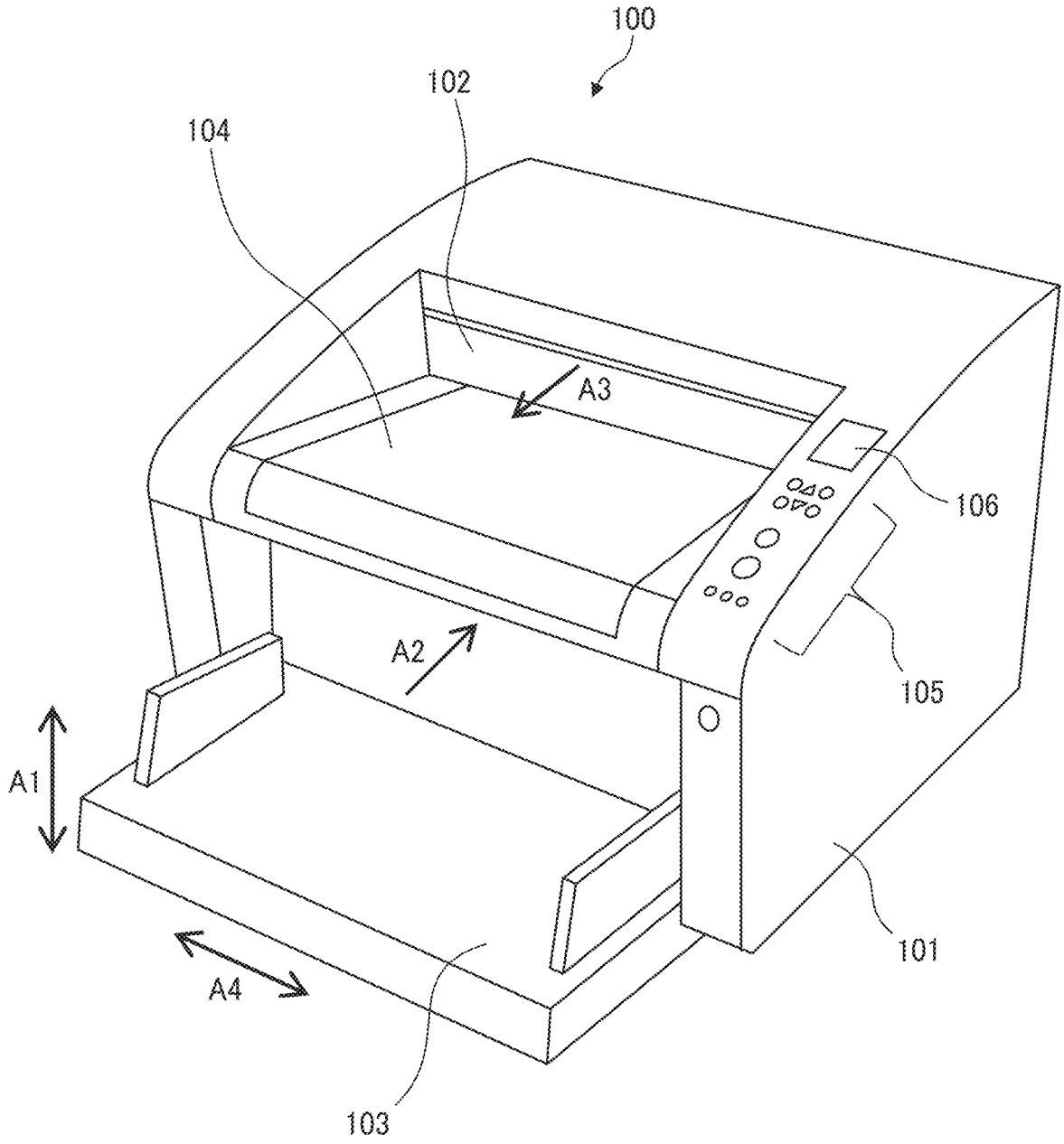
FIG. 1 is a perspective view of a media feeding apparatus.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a," "an," and "the" are intended to include the plural forms as well, unless the context clearly indicates otherwise.

A description is given below of a media feeding apparatus, a media feeding method, and a control program according to an aspect of the present disclosure, with reference to the drawings. The technical scope of the present disclosure, however, is not limited to the embodiments described below but includes the scope of the appended claims and the equivalents thereof.

FIG. 1 is a perspective view of a media feeding apparatus 100 configured as an image scanner. The media feeding apparatus 100 conveys and images media, which are original documents. The media are, for example, sheets of plain paper, sheets of thick paper, or cards. Alternatively, the media feeding apparatus 100 may be, for example, a facsimile machine, a copier, or a multifunction peripheral (MFP). The medium to be conveyed may be, for example, an object to be printed instead of an original document, and the media feeding apparatus 100 may be, for example, a printer.

In FIG. 1, arrow A1 indicates the substantially vertical direction (may be referred to as the height direction A1 in the following direction), and arrow A2 indicates the direction in which media are conveyed (may be referred to as the media conveyance direction A2 in the following description). Further, arrow A3 indicates the direction in which the media are ejected (may be referred to as the medium ejection direction A3 in the following description), and arrow A4 indicates the width direction of the media feeding apparatus 100 (may be referred to as the width direction A4 in the following description) orthogonal to the media conveyance direction A2 or the media ejection direction A3. In the following description, the term "upstream" refers to "upstream" in the media conveyance direction A2 or the media ejection direction A3, whereas the term "downstream" refers to "downstream" in the media conveyance direction A2 or the media ejection direction A3.

The media feeding apparatus 100 includes, for example, a first housing 101, a second housing 102, a media table 103, an ejection table 104, an operation device 105, and a display device 106.

The second housing 102 is located inside the first housing 101 and is rotatably engaged with the first housing 101 with a hinge such that the second housing 102 can be opened and closed to, for example, remove a jammed medium or clean the inside of the media feeding apparatus 100.

The media table 103 is engaged with the first housing 101 such that the media to be conveyed are placed on the media table 103. The media table 103 is movable in the height direction A1, that is, up and down, on a media-supply side of the first housing 101. The media-supply side of the first housing 101 is the side from which the media are supplied into the first housing 101. When no media are conveyed, the media table 103 is positioned at the lower end of the movable range to facilitate the placement of media thereon. When a medium is conveyed, the media table 103 is raised to the position at which the medium on the top of the media table 103 contacts a pick roller described later.

The ejection table 104 is formed on the second housing 102. The ejection table 104 stacks the media ejected from an ejection port defined by the first housing 101 and the second housing 102.

The operation device 105 includes an input device such as keys and an interface circuit that acquires signals from the input device. The operation device 105 receives an input operation performed by a user and outputs an operation signal corresponding to the input operation performed by the user. The display device 106 includes a display and an interface circuit that outputs image data to the display and displays the image data on the display. Examples of the display include a liquid crystal and an organic electroluminescence (EL). The display device 106 may be a liquid crystal display with a touch panel function. In this case, the operation device 105 includes an interface circuit that acquires input signals from the touch panel.

Figure 2:
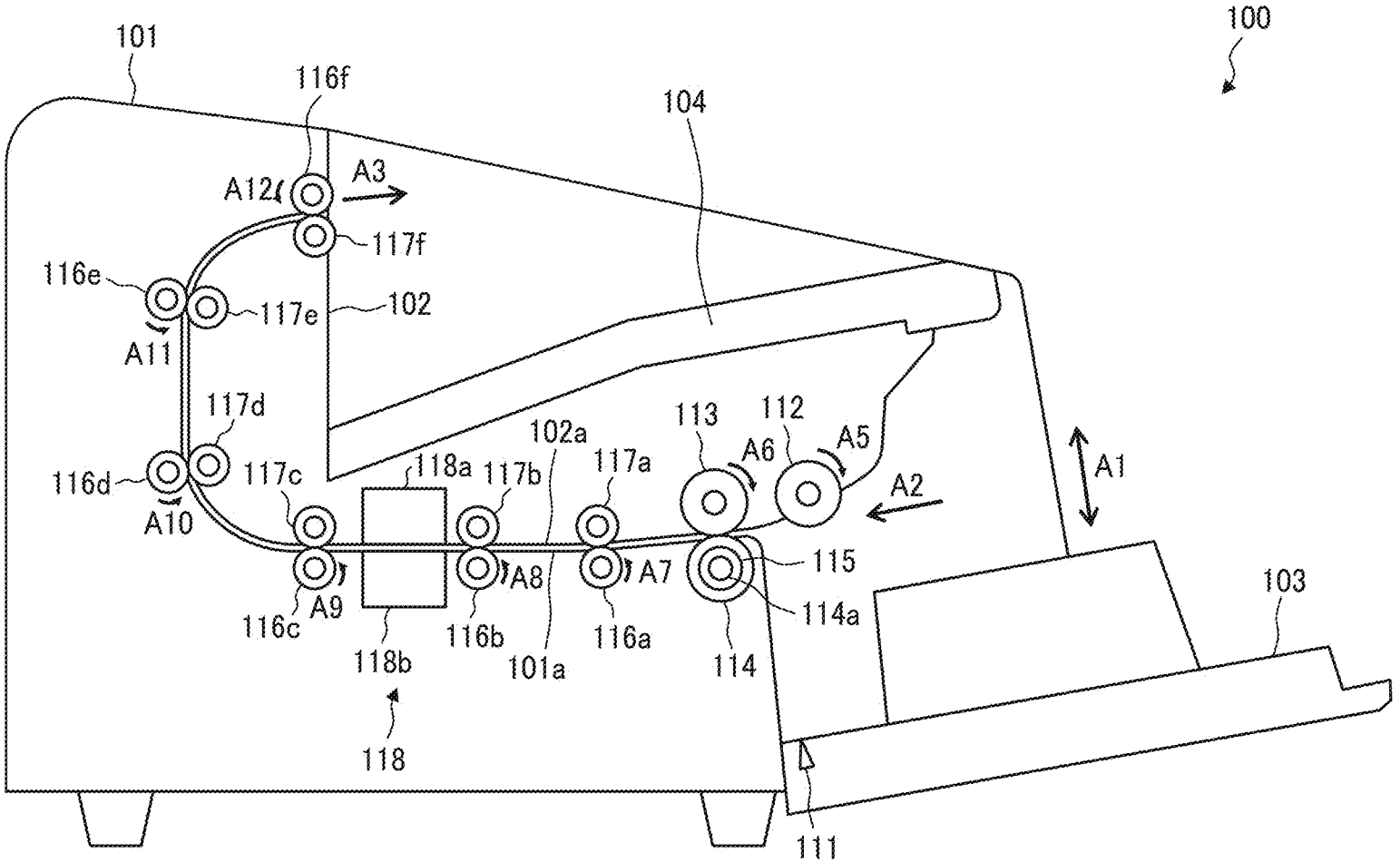
FIG. 2 is a diagram illustrating a conveyance path in the media feeding apparatus of FIG. 1.

FIG. 2 is a diagram illustrating a conveyance path in the media feeding apparatus 100.

The media feeding apparatus 100 includes, along the conveyance path, a media sensor 111, a pick roller 112, a feed roller 113, a separation roller 114, a torque limiter 115, first to sixth conveyance rollers 116*a* to 116*f*, first to sixth driven rollers 117*a* to 117*f*, and an imaging device 118.

The number of each of the pick roller 112, the feed roller 113, the separation roller 114, the first conveyance roller 116*a*, the second conveyance roller 116*b*, the third conveyance roller 116*c*, the fourth conveyance roller 116*d*, the fifth conveyance roller 116*e*, the sixth conveyance roller 116*f*, the first driven roller 117*a*, the second driven roller 117*b*, the third driven roller 117*c*, the fourth driven roller 117*d*, the fifth driven roller 117*e*, and/or the sixth driven roller 117*f* is not limited to one, and may be two or more. When the number is two or more, feed rollers 113 are aligned with and spaced apart from each other in the width direction A4. In the same manner, separation rollers 114, first conveyance rollers 116*a*, second conveyance rollers 116*b*, third conveyance rollers 116*c*, fourth conveyance rollers 116*d*, fifth conveyance rollers 116*e*, the sixth conveyance rollers 116*f*, the first driven rollers 117*a*, the second driven rollers 117*b*, the third driven rollers 117*c*, the fourth driven rollers 117*d*, the fifth driven rollers 117*e*, and/or the sixth driven rollers 117*f* are also aligned with and spaced apart from each other in the width direction A4.

The second housing 102 faces the first housing 101 across a media conveyance passage in which media are conveyed. The first housing 101 has a face facing the second housing 102 to form a first guide 101*a* of the media conveyance passage. The second housing 102 has a face facing the first housing 101 to form a second guide 102*a* of the media conveyance passage.

The media sensor 111 is located on the media table 103, that is, upstream from the feed roller 113 and the separation roller 114, and detects the media placed on the media table 103. The media sensor 111 determines whether media are placed on the media table 103 using a contact sensor that causes a predetermined amount of electric current to flow when media are in contact with the sensor or no media are in contact with the sensor. The media sensor 111 generates and outputs a first media signal whose signal value changes depending on whether media are placed on the media table 103. The media sensor 111 is not limited to a contact detection sensor, and any other sensor such as an optical detection sensor that can detect the presence of media may be used as the media sensor 111.

The pick roller 112 is located upstream from the feed roller 113 and the separation roller 114 in the media conveyance direction A2 in the second housing 102. The pick roller 112 is located above the media table 103 and feeds media placed on the media table 103. Specifically, the pick roller 112 contacts the uppermost medium of the media on the media table 103, which is raised to substantially the same height as the height of the media conveyance passage, and feeds the uppermost medium downstream in the media conveyance passage.

The feed roller 113 is located downstream from the pick roller 112 in the second housing 102, and feeds the medium fed from the media table 103 by the pick roller 112 further downstream in the media conveyance passage. The separation roller 114 is located facing the feed roller 113 in the first housing 101. The separation roller 114 is located on a shaft 114*a* which is a rotation shaft to which power is not transmitted. The separation roller 114 is a so-called brake roller and can be stopped by the torque limiter 115. The feed roller 113 and the separation roller 114 perform an operation of separating media and feed the media one by one. The feed roller 113 is located above the separation roller 114, and the media feeding apparatus 100 feeds a medium by a so-called top-sheet feeding method.

In this way, the separation roller 114 separates media using the torque limiter 115 without using the driving force of a driving source (motor). Since the separation roller 114 is not driven by power, the media feeding apparatus 100 does not have a motor for driving the separation roller 114. Accordingly, the apparatus cost, the apparatus size, and the apparatus weight can be reduced. Further, since the media feeding apparatus 100 does not include a transmission mechanism such as a gear, a pulley, and a roller that transmits the driving force from the motor to the separation roller 114, the apparatus cost, the apparatus size, and the apparatus weight can be reduced.

The torque limiter 115 is located on the shaft 114*a*, which is the rotation shaft of the separation roller 114, and controls a load applied to the separation roller 114. Since there is no gear train between the torque limiter 115 and the separation roller 114, the separation force applied to the separation roller 114 is prevented from varying due to manufacturing errors of components. Therefore, the media feeding apparatus 100 can separate a medium with high accuracy regardless of the manufacturing errors of components.

The first to sixth conveyance rollers 116*a* to 116*f* and the first to sixth driven rollers 117*a* to 117*f* are located downstream from the feed roller 113 and the separation roller 114 in the media conveyance direction A2 such that the first to sixth conveyance rollers 116*a* to 116*f* face the first to sixth driven rollers 117*a* to 117*f*, respectively. The first to sixth conveyance rollers 116*a* to 116*f* and the first to sixth driven rollers 117*a* to 117*f* convey a medium fed by the feed roller 113 and the separation roller 114 downstream in the media conveyance direction A2. The sixth conveyance roller 116*f* and the sixth driven roller 117*f* eject the medium to the ejection table 104.

The imaging device 118 is located downstream from the first conveyance roller 116*a* and the second conveyance roller 116*b* in the media conveyance direction A2, and captures an image of the medium conveyed by the first and second conveyance rollers 116*a* and 116*b* and the first and second driven rollers 117*a* and 117*b*. The imaging device 118 includes a first imaging device 118*a* and a second imaging device 118*b* that are located facing each other across the media conveyance passage. The first imaging device 118*a* is located in the second housing 102, and the second imaging device 118*b* is located in the first housing 101.

The first imaging device 118*a* includes, as a line sensor, a contact image sensor (CIS) employing an equal-magnification optical system and including, as imaging elements, complementary metal oxide semiconductors (CMOSs) aligned linearly in the main-scanning direction. The first imaging device 118*a* further includes a lens that forms an image on the imaging elements and an analog-to-digital (A/D) converter. The A/D converter amplifies the electric signals output from the imaging elements and performs A/D conversion. The first imaging device 118*a* images the front side of the medium being conveyed, generates an input image, and outputs the input image.

Similarly, the second imaging device 118*b* includes, as a line sensor, a CIS employing the equal-magnification optical system and including, as imaging elements, CMOSs aligned linearly in the main-scanning direction. The second imaging device 118*b* further includes a lens that forms an image on the imaging elements and an A/D converter. The A/D converter amplifies the electric signals output from the imaging elements and performs A/D conversion. The second imaging device 118*b* images the back side of the medium being conveyed, generates an input image, and outputs the input image.

Alternatively, the media feeding apparatus 100 may include either the first imaging device 118*a* or the second imaging device 118*b* to read only one side of the medium. The line sensor may be, instead of the CIS employing the equal-magnification optical system and including CMOSs as imaging elements, a CIS employing the equal-magnification optical system and including charge-coupled devices (CCDs) as imaging elements. Alternatively, a line sensor employing a reduction optical system and including, as imaging elements, CMOSs or CCDs may be used.

As the pick roller 112 and the feed roller 113 rotate in media feeding directions A5 and A6, respectively, the medium is conveyed from the media table 103 in the media conveyance direction A2 between the first guide 101*a* and the second guide 102*a*. When the separation roller 114 stops, the feeding of media other than the separated medium is restricted (i.e., double feeding is prevented).

As the first and second conveyance rollers 116*a* and 116*b* rotate in the directions indicated by arrows A7 and A8, respectively, the medium is fed to the imaging position in the imaging device 118 while being guided by the first guide 101*a* and the second guide 102*a*. At the imaging position, the imaging device 118 images the medium. As the third to sixth conveyance rollers 116*c* to 116*f* rotate in the directions indicated by arrows A9 to A12, respectively, the medium is ejected onto the ejection table 104.

Figure 3:
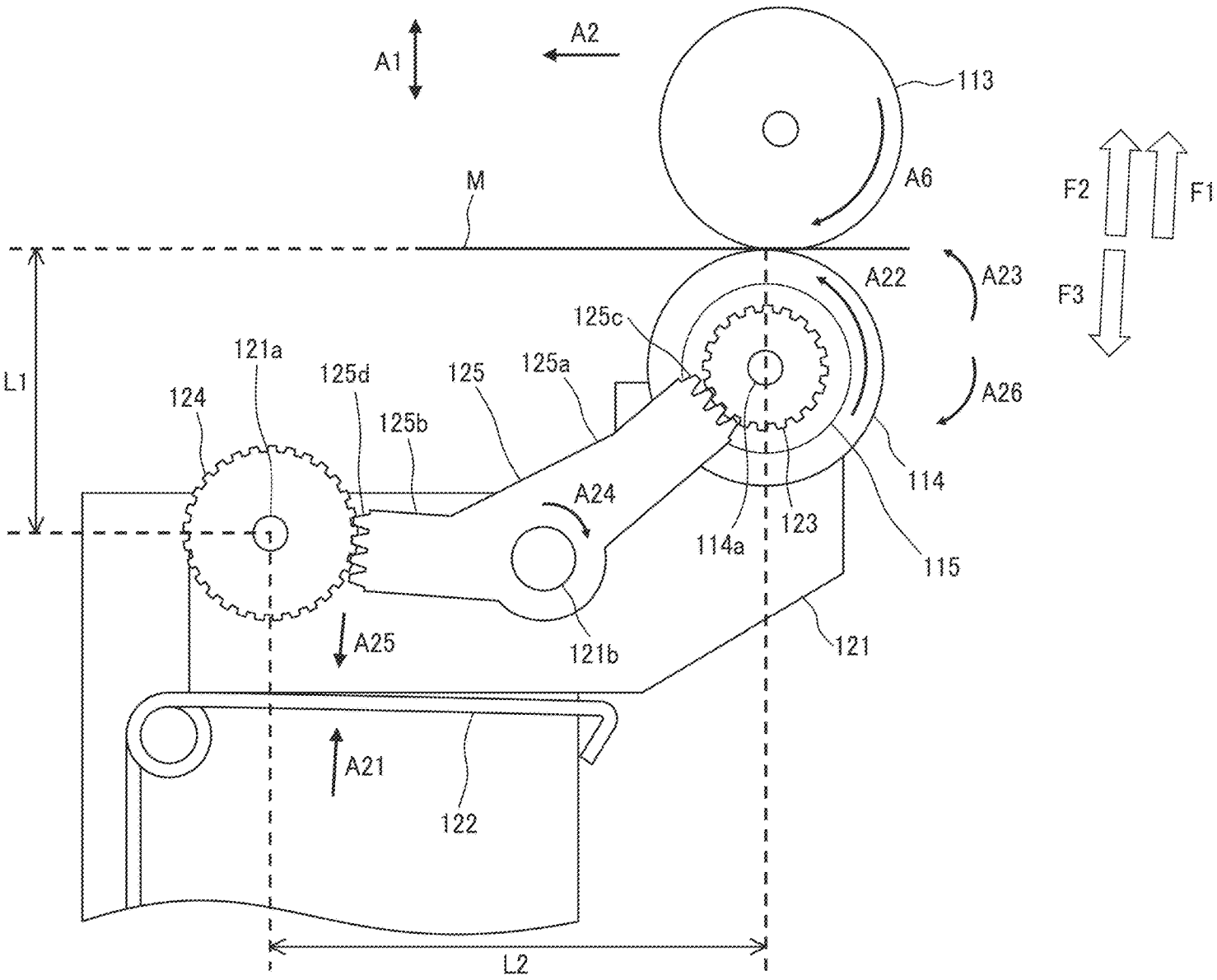
FIG. 3 is a schematic view of a separation roller unit.

FIG. 3 is a schematic view of a separation roller unit 121.

As illustrated in FIG. 3, the media feeding apparatus 100 further includes the separation roller unit 121, a pressing portion 122, a first transmission portion 123, an engaging portion 124, a second transmission portion 125, etc.

The separation roller unit 121 is an example of a unit. The shaft 114*a*, which is a rotation shaft of the separation roller 114, is attached to an upstream end of the separation roller unit 121 in the media conveyance direction A2, and the separation roller unit 121 supports the shaft 114*a*. The separation roller unit 121 is swingable about a swing shaft 121*a* which is located at a downstream end of the separation roller unit 121 in the media conveyance direction A2. Thus, the separation roller 114 attached to the upstream end of the separation roller unit 121 in the media conveyance direction A2 is movable in the height direction A1, that is, toward the feed roller 113 and away from the feed roller 113.

The pressing portion 122 is an elastic member such as a torsion coil spring. The pressing portion 122 is located below the separation roller unit 121 and generates a pressing force in an upward direction A21. One end (one arm) of the pressing portion 122 is coupled to a frame in the first housing 101, and the other end (the other arm) of the pressing portion 122 is attached to the separation roller unit 121. As a result, the pressing portion 122 presses the separation roller unit 121 upward. In other words, the pressing portion 122 applies a pressing force to the separation roller unit 121 to swing the separation roller unit 121 such that the separation roller 114 is pressed toward the feed roller 113. The pressing portion 122 may be, for example, a compression coil spring, a plate spring, or rubber. The media feeding apparatus 100 can employ the elastic member as the pressing portion 122 to stably apply the pressing force to the separation roller 114 at low cost.

The first transmission portion 123 is a gear. The first transmission portion 123 is located on the shaft 114*a* of the separation roller 114 attached to the upstream end of the separation roller unit 121 such that the first transmission portion 123 rotates with rotation of the shaft 114*a*. The first transmission portion 123 transmits the rotational force in a media feeding direction A22, which is generated when the separation roller 114 is driven by the feed roller 113, to the engaging portion 124 via the second transmission portion 125.

The engaging portion 124 is a gear. The engaging portion 124 is fixed to the swing shaft 121*a* located at the downstream end of the separation roller unit 121.

The second transmission portion 125 is a cam. The second transmission portion 125 is located between the first transmission portion 123 and the engaging portion 124. The second transmission portion 125 is attached to the separation roller unit 121 and rotatable about a rotation shaft 121*b* located between the first transmission portion 123 and the engaging portion 124 in the media conveyance direction A2. The second transmission portion 125 includes a first arm 125*a* extending upstream in the media conveyance direction A2 and a second arm 125*b* extending downstream in the media conveyance direction A2. A first teeth portion 125*c* engaged with the first transmission portion 123 is located at the upstream end of the first arm 125*a*. A second teeth portion 125*d* engaged with the engaging portion 124 is located at the downstream end of the second arm 125*b*. In the media conveyance direction A2, the first arm 125*a* engaged with the first transmission portion 123 is longer than the second arm 125*b* engaged with the engaging portion 124. The second transmission portion 125 transmits the rotational force in the direction in which the separation roller 114 is driven by the feed roller 113, which is transmitted from the first transmission portion 123, to the engaging portion 124.

Since the second transmission portion 125 extends along the media conveyance direction A2, the size of the second transmission portion 125 in the height direction A1 is reduced. Since the size of the second transmission portion 125 in the height direction A1 is reduced, the designer of the media feeding apparatus 100 can design the medium conveyance passage without worrying about the influence of the second transmission portion 125 protruding into the media conveyance passage while using a single member as the second transmission portion 125. Therefore, the media feeding apparatus 100 can enhance the degree of freedom in design while preventing an increase in apparatus cost.

The first transmission portion 123, the engaging portion 124, and the second transmission portion 125 are an example of a reaction-force generator.

As described above, the torque limiter 115 is located on the shaft 114*a* which is the rotation shaft of the separation roller 114. In other words, the torque limiter 115 is located between the separation roller 114 and the shaft 114*a*. The first transmission portion 123, which rotates with the shaft 114*a*, is connected to the fixed engaging portion 124 via the second transmission portion 125, thus restricting the shaft 114*a* from rotating.

When a plurality of media are present between the feed roller 113 and the separation roller 114, the limit value of the torque limiter 115 is set to a value at which the rotational force is transmitted between the separation roller 114 and the shaft 114*a*. When a single medium is present between the feed roller 113 and the separation roller 114, the limit value of the torque limiter 115 is set to a value at which the rotational force is blocked between the separation roller 114 and the shaft 114*a*. Thus, the torque limiter 115 stops the separation roller 114 when a torque equal to or less than the limit value is applied, and causes the separation roller 114 to drive the feed roller 113 when a torque larger than the limit value is applied. The limit value of the torque limiter 115 is an example of a predetermined torque. In other words, when a plurality of media are conveyed, the separation roller 114 stops and separates a medium contacting the feed roller 113 from the other media, thus preventing the occurrence of double feeding. On the other hand, when only one medium is conveyed, the separation roller 114 is rotated by the feed roller 113.

The force applied to the separation roller 114 will be described below. The first force F1, the second force F2, and the third force F3 are applied to the separation roller 114.

The first force F1 is a force generated by the pressing force from the pressing portion 122. As described above, the pressing portion 122 applies a pressing force in the upward direction A21 to the separation roller unit 121. As a result, a swing force directed in the upward direction A23 is applied to the entire separation roller unit 121, and the first force F1 directed toward the feed roller 113 is applied to the separation roller 114. The first force F1 is a static force determined in accordance with, for example, the spring constant of the pressing portion 122, and is always applied to the separation roller 114 regardless of whether a medium is being fed.

The second force F2 is a force due to a rotational moment of the separation roller unit 121. When a medium M is fed by the feed roller 113, the rotational force of the feed roller 113 in the media feeding direction A6 is transmitted to the separation roller 114 through the medium M, and the rotational force in the media feeding direction A22 is applied to the separation roller 114. Accordingly, a rotational moment in the direction A23, which is the same as the media feeding direction A22, is applied to the entire separation roller unit 121, and the second force F2 directed toward the feed roller 113 is applied to the separation roller 114. In other words, the second force F2 is a dynamic force due to a rotational moment applied to the swing shaft 121*a* of the separation roller unit 121 in accordance with the torque applied to the torque limiter 115, and is applied such that the separation roller 114 bites into the feed roller 113. The second force F2 is applied to the separation roller 114 only during the feeding of the medium.

The second force F2 varies depending on the positional relationship between the nip position between the feed roller 113 and the separation roller 114 and the swing fulcrum of the separation roller 114. The second force F2 is calculated by the following equation (1).

$$F2 = \{(T/R) \times L1\}/L2, \tag{1}$$

where T is the limit value of the torque limiter 115, R is the radius of the separation roller 114, L1 is a distance between a nipping position of the feed roller 113 and the separation roller 114 in a direction orthogonal to a nipping plane of the feed roller 113 and the separation roller 114 and a swing center (position of the engaging portion 124) of the separation roller unit 121. L2 is a distance between a nipping position of the feed roller 113 and the separation roller 114 in a direction parallel to a nipping plane of the feed roller 113 and the separation roller 114 and a swing center (position of the engaging portion 124) of the separation roller unit 121.

The third force F3 is a force generated by a reaction force from the engaging portion 124. As described above, when a medium M is fed by the feed roller 113, the rotational force of the feed roller 113 in the media feeding direction A6 is transmitted to the separation roller 114 through the medium M, and the rotational force in the media feeding direction A22 is applied to the separation roller 114. By this rotational force, a rotational force in a clockwise direction A24 in FIG.

3 is applied to the first arm 125*a* of the second transmission portion 125 which is engaged with the first transmission portion 123 rotating with the shaft 114*a* of the separation roller 114. By this rotational force, the second arm 125*b* of the second transmission portion 125 applies a rotational force to the engaging portion 124 in an upward direction along a tangent line where the engaging portion 124 and the second arm 125*b* are in contact with each other.

As described above, since the engaging portion 124 is fixed, the second arm 125*b* receives a reaction force from the engaging portion 124 in a downward direction A25 along the tangent line where the engaging portion 124 and the second arm 125*b* are in contact with each other. By this reaction force, a swing force directed in a downward direction A26 is applied to the entire separation roller unit 121, and the third force F3 directed in a direction in which the separation roller 114 moves away from the feed roller 113 is applied to the separation roller 114. In other words, the third force F3 is a dynamic force generated in accordance with the torque applied to the torque limiter 115, and is applied such that the separation roller 114 moves away from the feed roller 113. The third force F3 is applied to the separation roller 114 only during the feeding of the medium.

The third force F3 varies according to the reduction ratio between the first transmission portion 123 and the engaging portion 124 via the second transmission portion 125, that is, the ratio between the magnitude of the torque applied to the first transmission portion 123 and the magnitude of the torque applied to the engaging portion 124. The third force F3 is calculated by the following equation (2).

$$F3 = (T/G)/L2, \tag{2}$$

where G is the reduction ratio between the first transmission portion 123 and the engaging portion 124 via the second transmission portion 125.

The reduction ratio G is calculated by the following equation (3), for example, when the teeth modules of the first transmission portion 123, the first arm 125*a*, the second arm 125*b*, and the engaging portion 124 are the same.

$$G = (R1/R2) \times (R3/R4), \tag{3}$$

where R1 is the rotation radius of the first transmission portion 123, R2 is the rotation radius of the first arm 125*a*, R3 is the rotation radius of the second arm 125*b*, and R4 is the rotation radius of the engaging portion 124. In other words, the third force F3 increases as the rotation radius R2 of the first arm 125*a* and the rotation radius R4 of the engaging portion 124 increase, and increases as the rotation radius R1 of the first transmission portion 123 and the rotation radius R3 of the rotation radius of the second arm 125*b* decrease.

In this manner, the second transmission portion 125 transmits, to the engaging portion 124, the rotational force that is transmitted from the first transmission portion 123 and directed in the direction in which the separation roller 114 is driven by the feed roller 113. In particular, the second transmission portion 125 transmits the rotational force to the engaging portion 124 by the engaging portion 124 so that a reaction force for swinging the separation roller unit 121 is generated against the rotational force such that the separation roller 114 moves away from the feed roller 113. In this manner, the first transmission portion 123, the engaging portion 124, and the second transmission portion 125 apply, to the separation roller unit 121, a reaction force for swinging the separation roller unit 121 such that the separation roller 114 moves away from the feed roller 113 as the separation roller 114 rotates.

In order for the feed roller 113 and the separation roller 114 to appropriately separate media, it is necessary for the feed roller 113 and the separation roller 114 to nip the media with a predetermined force. If the nipping force with which the feed roller 113 and the separation roller 114 nip the media is too large, double feeding of the media may occur. Therefore, the force of pressing the separation roller 114 toward the feed roller 113 and the force of moving the separation roller 114 away from the feed roller 113 need to be appropriately balanced.

As described above, the force of pressing the separation roller 114 toward the feed roller 113 includes the first force F1 due to the pressing force from the pressing portion 122 and the second force F2 due to the rotational moment of the separation roller unit 121. The first force F1 is a static force due to the pressing force of the pressing portion 122, and does not vary during the feeding of a medium. On the other hand, the second force F2 is a dynamic force generated with the feeding of the medium, and fluctuates in small steps due to slight vibration caused by irregularities formed on the surfaces (rubber) of the feed roller 113 and the separation roller 114, or due to the engagement timing of parts inside the torque limiter 115.

When the second force F2 is large with respect to the first force F1, the degree of variation of the force applied to the medium during feeding is large. If the force applied to the medium is increased, the nipping force with which the feed roller 113 and the separation roller 114 nip the medium may be too large and cause double feeding of media. If the force applied to the medium is reduced, a medium not to be fed may advance from between the feed roller 113 and the separation roller 114, and thus double feeding of media may occur. Therefore, in order to stabilize the force applied to the medium and prevent the occurrence of double feeding of media, it is desirable to increase the first force F1 and decrease the second force F2. However, since the second force F2 depends on the torque applied to the torque limiter 115 to be adjusted according to the characteristics of the medium to be fed, it is difficult to reduce the second force F2 in order to change the force of pressing the separation roller 114 toward the feed roller 113. On the other hand, if the first force F1 is simply increased, the nipping force with which the feed roller 113 and the separation roller 114 nip the medium becomes too large, and double feeding of media is likely to occur.

The media feeding apparatus 100 fixes the engaging portion 124 to apply the third force F3 generated by the reaction force from the engaging portion 124 to the separation roller 114 as the force of moving the separation roller 114 away from the feed roller 113. Accordingly, the media feeding apparatus 100 can increase the first force F1 based on the pressing force from the pressing portion 122, by the amount with which the third force F3 based on the reaction force from the engaging portion 124 is applied to the separation roller 114. Therefore, the media feeding apparatus 100 can increase the first force F1 that does not fluctuate during the medium feeding with respect to the second force F2 that fluctuates during the medium feeding, and can stably feed the medium.

As described above, the third force F3 also depends on the torque applied to the torque limiter 115, similarly with the second force F2. However, the third force F3 can be adjusted by adjusting the reduction ratio between the first transmission portion 123 and the engaging portion 124 via the second transmission portion 125, that is, by adjusting the length of the first arm 125*a* and the length of the second arm 125*b*. Accordingly, the media feeding apparatus 100 adjusts the speed reduction ratio by the second transmission portion 125 and thus can increase the third force F3 while appropriately adjusting the force applied to the separation roller 114. Accordingly, the media feeding apparatus 100 can further increase the first force F1 and stably feed the medium.

In particular, in the media feeding apparatus 100, the length of the first arm 125*a* is set to be longer than the length of the second arm 125*b*. Thus, the magnitude of the torque applied to the engaging portion 124 can be increased with respect to the magnitude of the torque applied to the first transmission portion 123, and the third force F3 can be further increased. Accordingly, the media feeding apparatus 100 can further increase the first force F1 and stably feed the medium.

For example, as the nipping position of the feed roller 113 and the separation roller 114 is farther from the swing center of the separation roller unit 121 in a direction parallel to the nipping plane of the feed roller 113 and the separation roller 114, the rotational moment of the separation roller unit 121 decreases. As the nipping position of the feed roller 113 and the separation roller 114 is closer to the swing center of the separation roller unit 121 in a direction perpendicular to the nipping plane of the feed roller 113 and the separation roller 114, the rotational moment of the separation roller unit 121 also decreases. Therefore, such configurations can reduce the second force F2. However, if the shape of the separation roller unit 121 is limited, the shape of the media conveyance passage is limited, and it is difficult to appropriately design the media conveyance passage. In the media feeding apparatus 100, the engaging portion 124 is fixed, and thus the medium can be stably fed while preventing the restriction of the degree of freedom of design.

Figure 4:
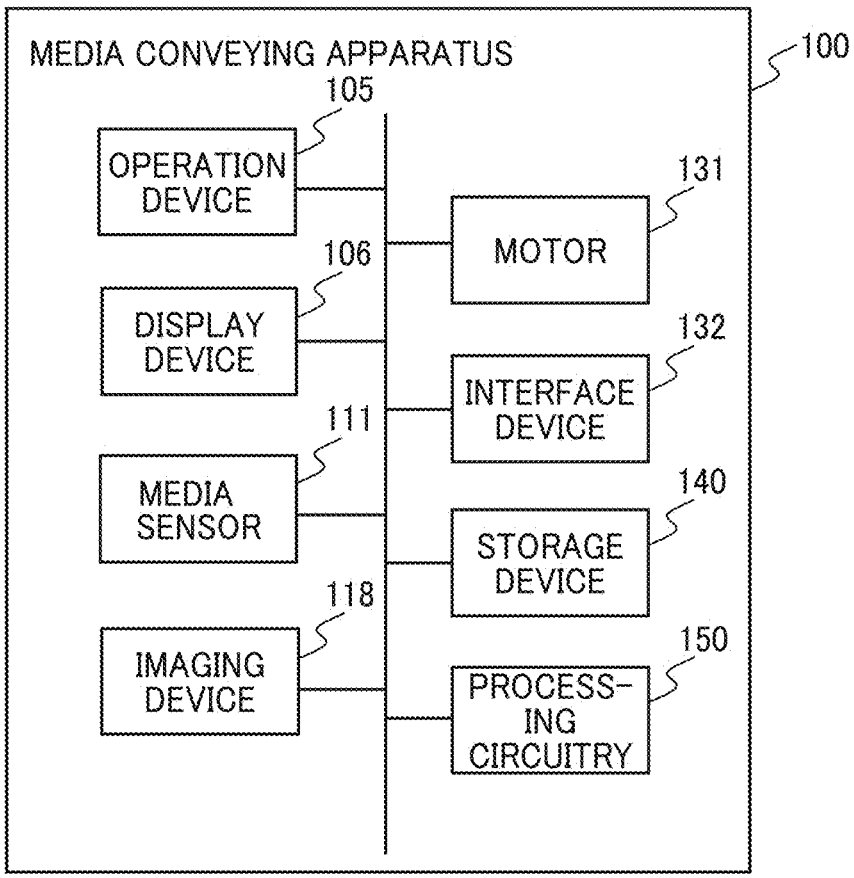
FIG. 4 is a block diagram illustrating a schematic configuration of the media feeding apparatus of FIG. 1.

FIG. 4 is a block diagram illustrating a schematic configuration of the media feeding apparatus 100.

The media feeding apparatus 100 further includes, for example, a motor 131, an interface device 132, a storage device 140, and processing circuitry 150, in addition to the above-described configuration.

The motor 131 includes one or more motors. The motor 131 rotates the pick roller 112, the feed roller 113, and the first to sixth conveyance rollers 116*a* to 116*f* to feed and convey a medium in accordance with a control signal from the processing circuitry 150. The separation roller 114 is not rotated by the driving force from the motor. The first to sixth driven rollers 117*a* to 117*f* may rotate in accordance with the driving force of the motor 131, instead of being rotated by the first to sixth conveyance rollers 116*a* to 116*f*. The motor 131 moves the media table 103 in accordance with a control signal from the processing circuitry 150.

The interface device 132 includes an interface circuit in compliance with a serial bus such as a universal serial bus (USB) and is electrically connected to an information processing device (for example, a personal computer or a mobile information processing terminal) to transmit and receive an input image and various kinds of information to and from the information processing device. The interface device 132 may be substituted by a communication unit including an antenna to transmit and receive radio signals and a wireless communication interface circuit to transmit and receive the signals through a wireless communication line according to a predetermined communication protocol. The predetermined communication protocol is, for example, a wireless local area network (LAN) communication protocol. The communication unit may include a wired communication interface circuit to transmit and receive signals through a wired communication line according to, for example, a wired LAN communication protocol.

The storage device 140 includes a memory device such as a random-access memory (RAM) or a read-only memory (ROM), a fixed disk device such as a hard disk, or a portable storage device such as a flexible disk or an optical disk. The storage device 140 stores computer programs, databases, tables, and other data used for various types of processing of the media feeding apparatus 100. The computer program may be installed from a portable computer-readable recording medium to the storage device 140 by using a known setup program, etc. The portable recording medium is, for example, a compact disc read-only memory (CD-ROM) and a digital versatile disc read-only memory (DVD-ROM). The computer programs may be distributed from, for example, a server and installed in the storage device 140.

The processing circuitry 150 operates based on a program previously stored in the storage device 140. The processing circuitry is, for example, a central processing unit (CPU). As the processing circuitry 150, for example, a digital signal processor (DSP), a large scale integration (LSI), an application-specific integrated circuit (ASIC), or a field-programmable gate array (FPGA) may be used.

The processing circuitry 150 is connected to the operation device 105, the display device 106, the media sensor 111, the imaging device 118, the motor 131, the interface device 132, the storage device 140, etc., to control each of these devices. The processing circuitry 150 controls, for example, the driving of the motors described above and the imaging by the imaging device 118, according to the signals received from the sensors described above. The processing circuitry 150 acquires an input image from the imaging device 118 and transmits the input image to the information processing apparatus via the interface device 132.

Figure 5:
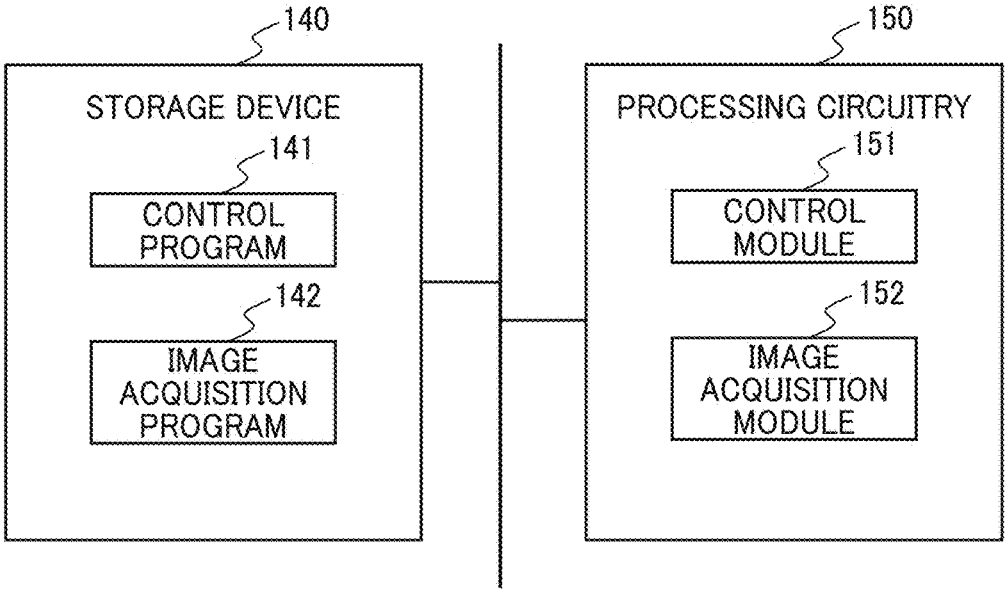
FIG. 5 is a schematic block diagram illustrating a schematic configuration of a storage device and processing circuitry.

FIG. 5 illustrates a schematic configuration of the storage device 140 and the processing circuitry 150.

As illustrated in FIG. 5, the storage device 140 stores a control program 141, an image acquisition program 142, etc. These programs are functional modules implemented by software operating on a processor. The processing circuitry 150 reads each program stored in the storage device 140 and operates in accordance with each read program. Thus, the processing circuitry 150 functions as a control module 151 and an image acquisition module 152.

Figure 6:
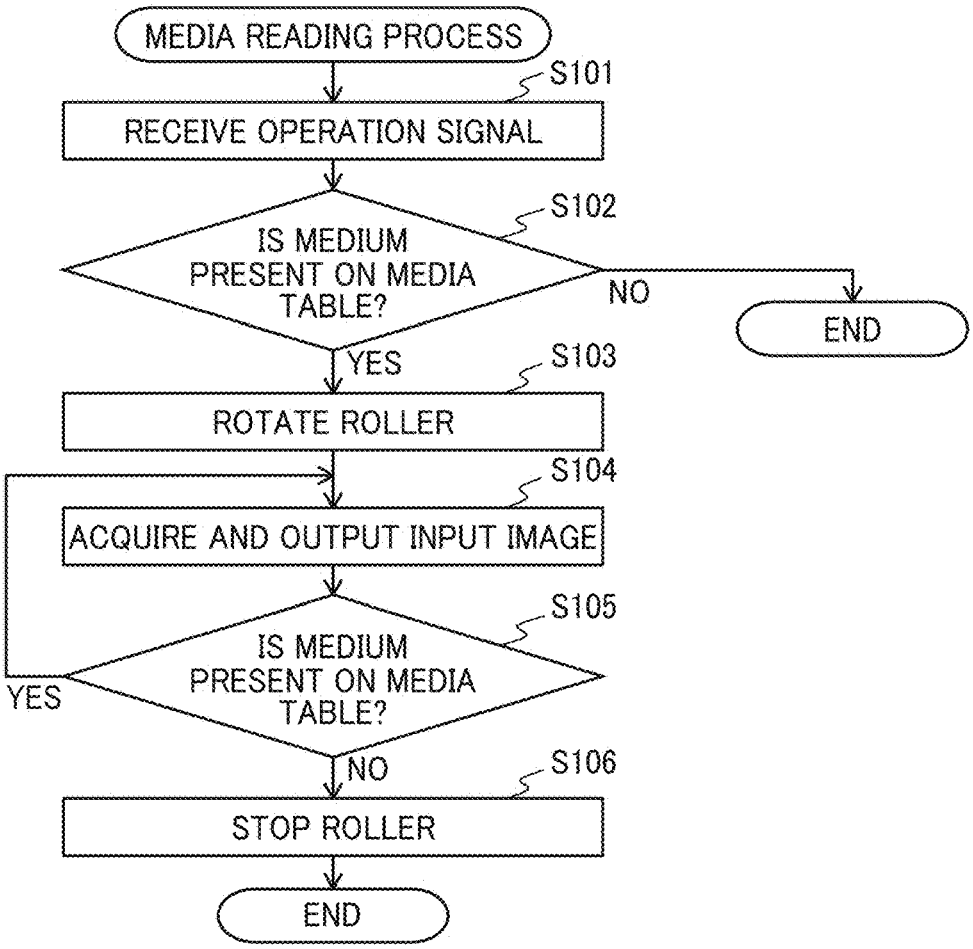
FIG. 6 is a flowchart illustrating an example of an operation of a medium reading process.

FIG. 6 is a flowchart illustrating an example of an operation of a media reading process of the media feeding apparatus 100.

An example of the operation of the media reading process of the media feeding apparatus 100 will be described below with reference to the flowchart illustrated in FIG. 6. The flow of the operation described below is performed primarily by the processing circuitry 150 in cooperation with each element of the media feeding apparatus 100 based on a program previously stored in the storage device 140.

First, the control module 151 waits until an instruction to read a medium is input by the user using the operation device 105 or an information processing apparatus and an operation signal indicating the reading of the medium is received from the operation device 105 or the interface device 132 (step S101).

Subsequently, the control module 151 acquires a media signal from the media sensor 111 and, based on the acquired media signal, determines whether a medium is placed on the media table 103 (step S102). When no medium is placed on the media table 103, the control module 151 terminates the series of steps.

On the other hand, when the medium is placed on the media table 103, the control module 151 drives the motor 131 to raise the media table 103 to a position where the medium can be fed, and rotates each roller to feed and convey the medium (step S103).

Subsequently, the control module 151 causes the imaging device 118 to image the medium, acquires an input image from the imaging device 118, and transmits the acquired input image to the information processing apparatus via the interface device 132 to output the input image (step S104).

Subsequently, the control module 151 determines whether a medium remains on the media table 103 based on the media signal received from the media sensor 111 (step S105). When a medium remains on the media table 103, the control module 151 returns the process to step S104 and repeats the processes of steps S104 and S105.

On the other hand, when no medium remains on the media table 103, the control module 151 controls the motor 131 to stop each roller (step 106), and terminates the series of steps.

As described above, the media feeding apparatus 100 separates media by the separation roller 114 located on the rotation shaft to which no power is transmitted. The media feeding apparatus 100 applies a reaction force to the separation roller unit 121 supporting the separation roller 114 such that the separation roller 114 moves away from the feed roller 113 as the separation roller 114 rotates. As a result, the media feeding apparatus 100 can feed the medium more satisfactorily while preventing increases in the apparatus cost, the apparatus size, and the apparatus weight.

Figure 7:
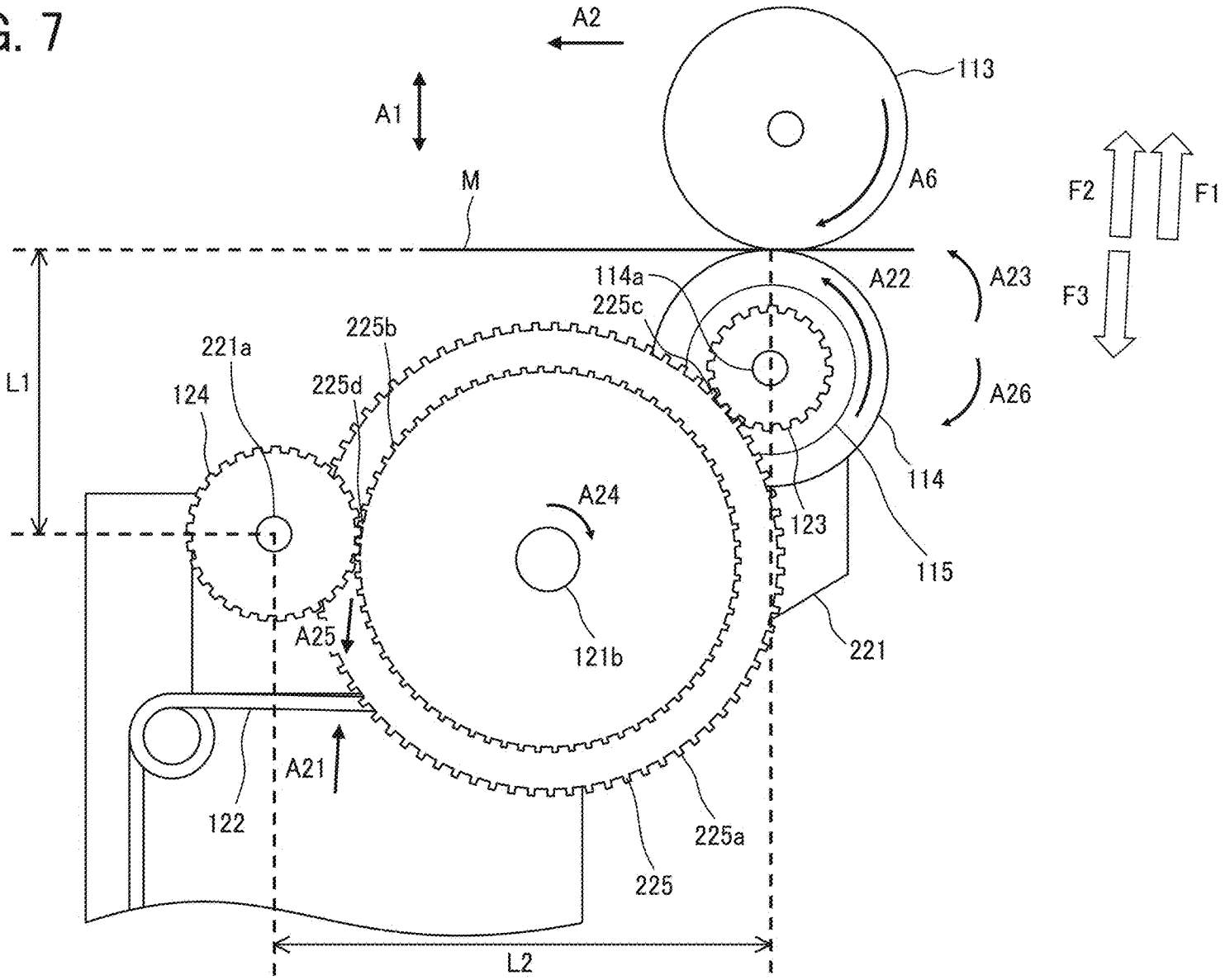
FIG. 7 is a schematic view of another separation roller unit.

FIG. 7 is a schematic view of a separation roller unit 221 of a media feeding apparatus according to another embodiment.

The media feeding apparatus according to the present embodiment includes a separation roller unit 221 and a second transmission portion 225 instead of the separation roller unit 121 and the second transmission portion 125.

The separation roller unit 221 has the same structure and function as the separation roller 114, and is swingable about a swing shaft 221*a* which is located at a downstream end of the separation roller unit 221 in the media conveyance direction A2. However, the separation roller unit 221 is provided with a second transmission portion 225 instead of the second transmission portion 125.

The second transmission portion 225 is a gear. The second transmission portion 225 is located between a first transmission portion 123 and an engaging portion 124. The second transmission portion 225 is attached to the separation roller unit 221 and rotatable about a rotation shaft 121*b* located between the first transmission portion 123 and the engaging portion 124 in the media conveyance direction A2. The second transmission portion 225 is a two-stage gear having a first gear portion 225*a* and a second gear portion 225*b*. The first gear portion 225*a* is provided with a first teeth portion 225*c* that engages with the first transmission portion 123. The second gear portion 225*b* is provided with a second teeth portion 225*d* that engages with the engaging portion 124. The rotation radius of the first gear portion 225*a* engaged with the first transmission portion 123 is greater than the rotation radius of the second gear portion 225*b* engaged with the engaging portion 124, and the number of teeth of the first gear portion 225*a* is greater than the number of teeth of the second gear portion 225*b*. In other words, the second transmission portion 225 functions as a speed reduction gear that transmits a rotational force from the first transmission portion 123 to the engaging portion 124 while changing the rotational force. The second transmission portion 225 transmits the rotational force that is transmitted from the first transmission portion 123 and directed in the direction in which the separation roller 114 is driven by the feed roller 113, to the engaging portion 124 via the first gear portion 225*a* and the second gear portion 225*b*.

Using a general-purpose two-stage gear as the second transmission portion 225 can prevent an increase in apparatus cost of the media feeding apparatus.

In the media feeding apparatus according to the present embodiment, the first force F1, the second force F2, and the third force F3 are applied to the separation roller 114 as in the media feeding apparatus 100.

The third force F3 is a force generated by a reaction force from the engaging portion 124, similarly to the third force F3 in the media feeding apparatus 100. By the rotational force of the separation roller 114 in the media feeding direction A22, a rotational force in a clockwise direction A24 in FIG. 7 is applied to the first gear portion 225*a* of the second transmission portion 225. By this rotational force, the second gear portion 225*b* of the second transmission portion 225 applies a rotational force to the engaging portion 124 in an upward direction along a tangent line where the engaging portion 124 and the second gear portion 225*b* are in contact with each other. The engaging portion 124 is fixed, and the second gear portion 225*b* receives a reaction force from the engaging portion 124 in a downward direction A25 along a tangent line where the engaging portion 124 and the second gear portion 225*b* are in contact with each other. By this reaction force, a swing force directed in a downward direction A26 is applied to the entire separation roller unit 221, and the third force F3 directed in a direction in which the separation roller 114 moves away from the feed roller 113 is applied to the separation roller 114.

The reduction ratio G between the first transmission portion 123 and the engaging portion 124 via the second transmission portion 225 is calculated by the following equation (4), for example, when the teeth modules of the first transmission portion 123, the first gear portion 225*a*, the second gear portion 225*b*, and the engaging portion 124 are the same.

$$G = (R1/R2)\times(R3/R4) = (N1/N2)\times(N3/N4), \quad (4)$$

where R1 is the rotation radius of the first transmission portion 123, R2 is the rotation radius of the first gear portion 225*a*, R3 is the rotation radius of the second gear portion 225*b*, R4 is the rotation radius of the engaging portion 124, N1 is the number of teeth of the first transmission portion 123, N2 is the number of teeth of the first gear portion 225*a*, N3 is the number of teeth of the second gear portion 225*b*, and N4 is the number of teeth of the engaging portion 124. In other words, the third force F3 increases as the rotation radius R2 of the first gear portion 225*a* and the rotation radius R4 of the engaging portion 124 increase, and increases as the rotation radius R1 of the first transmission portion 123 and the rotation radius R3 of the second gear portion 225*b* decrease. The third force F3 increases as the number of teeth N2 of the first gear portion 225*a* and the number of teeth N4 of the engaging portion 124 increase, and increases as the number of teeth N1 of the first transmission portion 123 and the number of teeth N3 of the second gear portion 225*b* decrease.

The second transmission portion 225 transmits, to the engaging portion 124, the rotational force that is transmitted from the first transmission portion 123 and directed in the direction in which the separation roller 114 is driven by the feed roller 113, as in the case of the second transmission portion 125. In particular, the second transmission portion 225 transmits the rotational force to the engaging portion 124 such that a reaction force for swinging the separation roller unit 221 is generated against the rotational force by the engaging portion 124 such that the separation roller 114 moves away from the feed roller 113. In this manner, the first transmission portion 123, the engaging portion 124, and the second transmission portion 225 apply, to the separation roller unit 221, the reaction force for swinging the separation roller unit 221 such that the separation roller 114 moves away from the feed roller 113 as the separation roller 114 rotates.

As described above, the media feeding apparatus can feed the medium more satisfactorily while preventing increases in the apparatus cost, the apparatus size, and the apparatus weight even when the separation roller unit 221 and the second transmission portion 225 are used.

Figure 8:
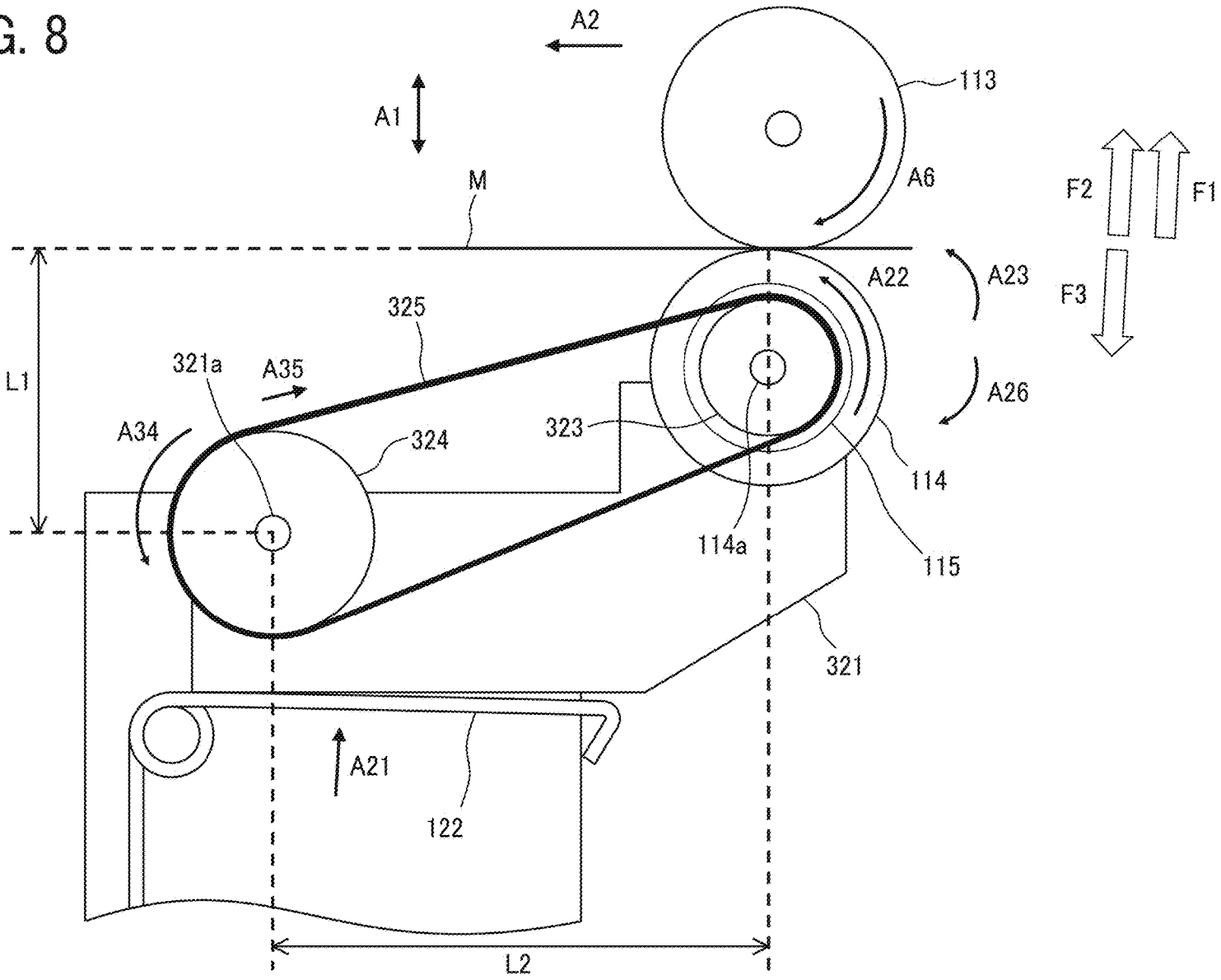
FIG. 8 is a schematic view of another separation roller unit.

FIG. 8 is a schematic view of a separation roller unit 321 of a media feeding apparatus according to still another embodiment.

The media feeding apparatus according to the present embodiment includes a separation roller unit 321, a first transmission portion 323, an engaging portion 324, and a second transmission portion 325, instead of the separation roller unit 121, the first transmission portion 123, the engaging portion 124, and the second transmission portion 125.

The separation roller unit 321 has the same structure and function as the separation roller 114. However, the separation roller unit 321 is provided with the first transmission portion 323, the engaging portion 324, and the second transmission portion 325 instead of the first transmission portion 123, the engaging portion 124, and the second transmission portion 125.

The first transmission portion 323 is a pulley. The first transmission portion 323 is located on the shaft 114*a* of the separation roller 114 such that the first transmission portion 323 rotates with the rotation of the shaft 114*a*. The first transmission portion 323 transmits the rotational force in a media feeding direction A22, which is generated when the separation roller 114 is driven by the feed roller 113, to the engaging portion 324 via the second transmission portion 325.

The engaging portion 324 is a pulley. The engaging portion 324 is fixed to a swing shaft 321*a* of the separation roller unit 321. The rotation radius of the engaging portion 324 is greater than the rotation radius of the first transmission portion 323, and the number of teeth of the engaging portion 324 is greater than the number of teeth of the first transmission portion 323.

The second transmission portion 325 is a belt. The second transmission portion 325 is suspended between the first transmission portion 323 and the engaging portion 324 so as to engage with the first transmission portion 323 and the engaging portion 324. The second transmission portion 325 transmits, to the engaging portion 324, the rotational force that is transmitted from the first transmission portion 323 and directed in the direction in which the separation roller 114 is driven by the feed roller 113.

Using general-purpose pulleys and a general-purpose belt as the first transmission portion 323, the engaging portion 324, and the second transmission portion 325 can prevent an increase in apparatus cost of the media feeding apparatus.

In the media feeding apparatus according to the present embodiment, the first force F1, the second force F2, and the third force F3 are applied to the separation roller 114 as in the media feeding apparatus 100.

The third force F3 is a force generated by a reaction force from the engaging portion 324, similarly to the third force F3 in the media feeding apparatus 100. By the rotational force of the separation roller 114 in the media feeding direction A22, a rotational force in a counterclockwise direction A34 in FIG. 8 is applied to the second transmission portion 325. By this rotational force, the second transmission portion 325 applies the rotational force in the counterclockwise direction A34 to the engaging portion 324. The engaging portion 324 is fixed, and the second transmission portion 325 receives a reaction force in a clockwise direction A35 from the engaging portion 324. By this reaction force, a force (rotational moment) directed in a downward direction A26 is applied to the entire separation roller unit 321, and the third force F3 directed in the direction away from the feed roller 113 is applied to the separation roller 114.

The reduction ratio G between the first transmission portion 323 and the engaging portion 324 via the second transmission portion 325 is calculated by the following equation (5).

$$G = R1 / R4 = N1 / N4, \tag{5}$$

where R1 is the rotation radius of the first transmission portion 323, R4 is the rotation radius of the engaging portion 324, N1 is the number of teeth of the first transmission portion 323, and N4 is the number of teeth of the engaging portion 124. In other words, the third force F3 increases as the rotation radius R4 of the engaging portion 124 increases, and also increases as the rotation radius R1 of the first transmission portion 123 decreases. The third force F3 increases as the number of teeth N4 of the engaging portion 124 increases, and also increases as the number of teeth N1 of the first transmission portion 123 decreases.

The second transmission portion 325 transmits, to the engaging portion 324, the rotational force that is transmitted from the first transmission portion 323 and directed in the direction in which the separation roller 114 is driven by the feed roller 113, as in the cases of the second transmission portions 125 and 225. In particular, the second transmission portion 325 transmits the rotational force to the engaging portion 324 such that a reaction force for swinging the separation roller unit 321 is generated against the rotational force by the engaging portion 324 such that the separation roller 114 moves away from the feed roller 113. In this manner, the first transmission portion 323, the engaging portion 324, and the second transmission portion 325 apply, to the separation roller unit 321, a reaction force for swinging the separation roller unit 321 such that the separation roller 114 moves away from the feed roller 113 as the separation roller 114 rotates.

As described above, even when the media feeding apparatus uses the separation roller unit 321, the first transmission portion 323, the engaging portion 324, and the second transmission portion 325, the media feeding apparatus can feed media more satisfactorily while preventing increases in the apparatus cost, the apparatus size, and the apparatus weight.

Figure 9:
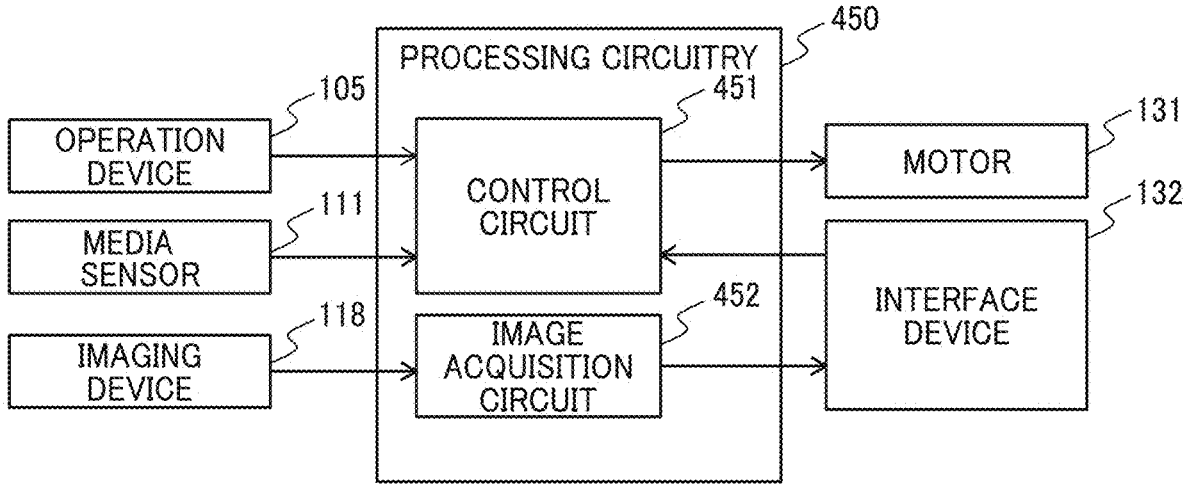
FIG. 9 is a diagram illustrating a schematic configuration of other processing circuitry.

FIG. 9 is a diagram illustrating a schematic configuration of a processing circuitry 450 of a media feeding apparatus according to another embodiment.

The processing circuitry 450 is used instead of the processing circuitry 150 of the media feeding apparatus 100, and executes, for example, a media reading process instead of the processing circuitry 150. The processing circuitry 450 includes a control circuit 451, an image acquisition circuit 452, etc. These circuits may be independent integrated circuits, microprocessors, firmware, etc.

The control circuit 451 is an example of a control unit and has the same function as the control module 151. The control circuit 451 receives operation signals from an operation device 105 or an interface device 132 and media signals from a media sensor 111. The control circuit 451 controls a motor 131 based on the received information.

The image acquisition circuit 452 is an example of an image acquisition unit and has the same function as the image acquisition module 152. The image acquisition circuit 452 acquires an input image from an imaging device 118 and outputs the input image to the interface device 132.

As described above, the media feeding apparatus can feed media more satisfactorily while preventing increases in the apparatus cost, the apparatus size, and the apparatus weight even when the processing circuitry 450 is used.

Although several embodiments of the present disclosure have been described above, the embodiments are not limited thereto. For example, in the media feeding apparatus, the feed roller may be located below the separation roller, and may feed and convey media placed on the media table in order from the lower side.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention. Any one of the above-described operations may be performed in various other ways, for example, in an order different from the one described above.

The invention claimed is:

1. A media feeding apparatus, comprising:

a feed roller to feed a medium;

a separation roller facing the feed roller and located on a rotation shaft to which power is not transmitted;

a torque limiter located on the rotation shaft, wherein the separation roller is driven by the feed roller when a torque greater than a predetermined torque is applied to the torque limiter;

a unit supporting the rotation shaft;

a pressing portion applying a pressing force to the unit to swing the unit in a direction in which the separation roller is pressed against the feed roller; and a reaction-force generator to generate a reaction force to swing the unit in a direction in which the separation roller moves away from the feed roller as the separation roller rotates.

2. The media feeding apparatus according to claim 1, wherein the reaction-force generator includes:

a first transmission portion located on the rotation shaft to transmit a rotational force in a direction in which the separation roller is driven by the feed roller;

an engaging portion fixed to a swing shaft of the unit; and a second transmission portion to transmit the rotational force to the engaging portion, wherein the second transmission portion transmits the rotational force to the engaging portion such that the engaging portion generates the reaction force against the rotational force.

3. The media feeding apparatus according to claim 2, wherein the first transmission portion, the engaging portion, and the second transmission portion are gears.

4. The media feeding apparatus according to claim 2, wherein the first transmission portion and the engaging portion are gears, and the second transmission portion is a cam having a first arm engaged with the first transmission portion and a second arm engaged with the engaging portion.

5. The media feeding apparatus according to claim 1, wherein the pressing portion is an elastic member.

6. A media feeding apparatus, comprising:

a feed roller to feed a medium;

a separation roller facing the feed roller and located on a rotation shaft to which power is not transmitted;

a torque limiter located on the rotation shaft, wherein the separation roller is driven by the feed roller when a torque greater than a predetermined torque is applied to the torque limiter;

a unit supporting the rotation shaft;

a spring or a rubber applying a pressing force to the unit to swing the unit in a direction in which the separation roller is pressed against the feed roller; and a gear or a cam to generate a reaction force to swing the unit in a direction in which the separation roller moves away from the feed roller as the separation roller rotates.

* * * * *